United States Patent [19]

Riedel

[11] 3,989,271

[45] Nov. 2, 1976

[54] AUTOMATIC BRAKE FOR SKI

[75] Inventor: Tilo Riedel, Eching, Germany

[73] Assignee: S.A. Etablissements Francois Salomon & Fils, Annecy, France

[22] Filed: Mar. 12, 1975

[21] Appl. No.: 557,476

[30] Foreign Application Priority Data

| | | |
|---|---|---|
| Mar. 15, 1974 | Germany | 2412623 |
| July 26, 1974 | Germany | 2436155 |
| Feb. 20, 1975 | Germany | 2507371 |

[52] U.S. Cl. ..... 280/605; 280/11.37 A

[51] Int. Cl.[2] ..... A63C 7/10; A63C 11/02

[58] Field of Search ..... 280/11.13 B, 11.37 R, 280/11.13 C, 605, 11.37 A

[56] References Cited

UNITED STATES PATENTS

| | | | |
|---|---|---|---|
| 3,195,911 | 7/1965 | Cubberly | 280/11.13 B |
| 3,715,126 | 2/1973 | Schwarz | 280/11.13 B |
| 3,724,867 | 4/1973 | Hawthorne | 280/11.13 C |
| 3,884,487 | 5/1975 | Wehrli | 280/11.13 B |

FOREIGN PATENTS OR APPLICATIONS

| | | | |
|---|---|---|---|
| 218,073 | 1/1910 | Germany | 280/11.13 B |
| 349,911 | 12/1960 | Switzerland | 280/11.13 B |

*Primary Examiner*—M. H. Wood, Jr.
*Assistant Examiner*—David M. Mitchell
*Attorney, Agent, or Firm*—Karl F. Ross; Herbert Dubno

[57] ABSTRACT

An automatic brake for a ski comprises a resiliently deformable wire of generally U shape and having a pair of pivot portions which extend parallel to the upper face of the ski and at an acute angle to the longitudinal axis of the ski. These portions are pivoted in a support plate and actuation portions extending back from the pivot portions allow the wire to be deformed and flattened out in a planar manner on top of the ski. Brake elements are carried on this wire so that when it is stepped on and flattened out these brake elements lie on top of the ski out of the way, but when a skiboot is taken off the wire they spring down and project beyond the lower face of the ski so as to prevent it from sliding.

11 Claims, 12 Drawing Figures

AUTOMATIC BRAKE FOR SKI

FIELD OF THE INVENTION

The present invention relates to a ski brake. More particularly this invention concerns a ski brake which is automatically actuated when the skier's boot is lifted from the ski so as to stop forward motion of the ski.

BACKGROUND OF THE INVENTION

An extremely dangerous situation is created if, as a result of a skier taking a fall, a free ski is permitted to slide freely down the ski slope. All alone such a free ski can attain considerable velocity and, if it collides with someone, it can cause serious injury. As a rule safety straps are worn which connect the skiboot of the skier to the ski binding, so that even if the skiboot is pulled off a ski connection is maintained with the ski. Such a safety strap, however, is itself frequently pulled loose if a bad fall is taken.

To this end, so-called ski brakes have been developed which generally and most basically comprise a brake element, usually formed as a shovel, and means for swinging the brake element into an actuated position extending transverse to the ski and down beyond the lower face of the ski. Actuation of such a brake is automatic on displacement of the skiboot away from the ski so that the ski itself is automatically stopped, or at least prevented from moving at any appreciable rate of speed. This automatic actuation arrangement usually comprises at least one spring that is loaded as the skiboot is pressed down on the upper face of the ski.

In a typical arrangement the brake elements, formed as small shovels, are pivotal about an axis perpendicular to the longitudinal direction of the ski and spaced above the upper face of the ski behind the skiboot. A torsion spring wound around this axis loads the elements and a catch is provided that is actuated as the boot is lifted off the ski to unload the spring and cause the brake elements to pivot down from their position parallel to the ski into a position perpendicular to the ski and extending below the lower face thereof.

A ski brake is also known which has a pair of leaf springs screwed to the ski toward the front and so constructed that their rear end portions normally stand up. The lateral edges are extended as shovel-like brake elements and when the spring is unstressed extend down towards the ground. When a skiboot is secured on top of these elements the brake elements are lifted and lie parallel to the edge of the ski. Such an arrangement has the considerable disadvantage that these elements extending from the sides of the skis can become caught and cause injury to the skier or can catch on some object and become bent out of shape.

Most such prior-art ski brakes not only have relatively complicated actuating mechanisms, but present the difficulty of often burdensome structure on the top face of the skis. Not only does this make donning the skis more difficult, but considerably augments the cost of the skis. Furthermore this extra structure is failure prone in that if it catches on something like a root or the like it is damaged. Furthermore such complicated ski brakes ice up and become completely inoperative.

OBJECTS OF THE INVENTION

It is therefore an object of the present invention to provide an improved ski brake.

Another object is provision of such a brake which is relatively simple in design yet sure in operation.

A further object is to provide a ski brake which does not clutter up the top of the ski.

Another object is a ski brake which is inexpensive to manufacture and which has a long service life.

SUMMARY OF THE INVENTION

These objects are attained according to the present invention in a ski brake having support means secured to the ski and defining a pivot axis extending parallel to the upper face of the ski and at an acute angle to the longitudinal direction of the ski. A resiliently deformable wire has a pivot portion pivotal in the support means about this pivot axis and an actuation portion extending from and at an angle to the pivot portion and engageable by the skiboot to pivot the wire about its pivot portion. A brake element is carried on the wire and extends generally parallel to the actuation portion with this brake element therefore being displaceable between an actuating position extending transverse to the upper face of the ski and beyond the lower face of the ski and an ineffective position extending generally parallel to the ski.

In accordance with further features of this invention the wire is at least partially U-shaped and has a pair of generally parallel legs constituting the actuation portion, each leg being provided with a respective such pivot portion rotatable about a respective pivot axis in the support plate constituting the means secured to the ski. In addition the wire carries a pair of such brake elements which are generally parallel to each other and lie on opposite sides of the ski, extending forwardly from the respective pivot portions and extending generally in the opposite direction from the ends of the legs.

It is also possible in accordance with the present invention to form the wire with the pivot portions extending generally toward one another. In this case the brake elements are carried on and extended generally in line with the legs.

According to other features of this invention the pivot portions extend generally away from each other and have inner ends from which extend the legs' outer ends from which generally parallel end portions of the wire extend generally parallel to the actuation portions. The brake elements are carried on these end portions. Means is provided for displacing the pivot axes on displacement of the acutation portion from the actuated position to the ineffective position so as to decrease the angle they form with each other and thereby displace the brake elements toward each other. Thus as a skiboot comes down on the actuation portion of the arrangement it not only swings the brake up so that the elements lie parallel to the ski, but also pivots these elements inwardly up to the skis so as to move them completely out of the way.

This is effected according to the present invention by connecting the bight portion interconnecting the legs to a toggle having one end fixed relative to the ski and another end secured to the bight portion so that depression of the toggle toward the upper face of the ski pushes the bight portion back away from the pivot axes. The wire is generally planar in its actuated position and is stressed in its ineffective position. Thus the pivot portions extend at an angle to the plane of the wire in the actuated position in which the wire is substantially unstressed.

In accordance with yet another feature of this invention each brake element includes a back portion extending in line with the brake element back past the respective pivot portion. These back portions are engageable by a skiboot to displace the brake into its ineffective position.

The brake according to this invention is relatively simple in construction and can therefore be made at very low cost. In addition it is almost impossible for it to ice up and become ineffective as all of the operating structure is hidden under the skiboot. Furthermore the arms carrying the brake elements are moved in under the skiboot under normal conditions so that the arrangement constitutes virtually no hindrance to use of the ski.

BRIEF DESCRIPTION OF THE DRAWING

The above and other objects, features, and advantages of the invention will become more readily apparent from the following description, reference being made to the accompanying drawing in which.

SPECIFIC DESCRIPTION

Figure 1:
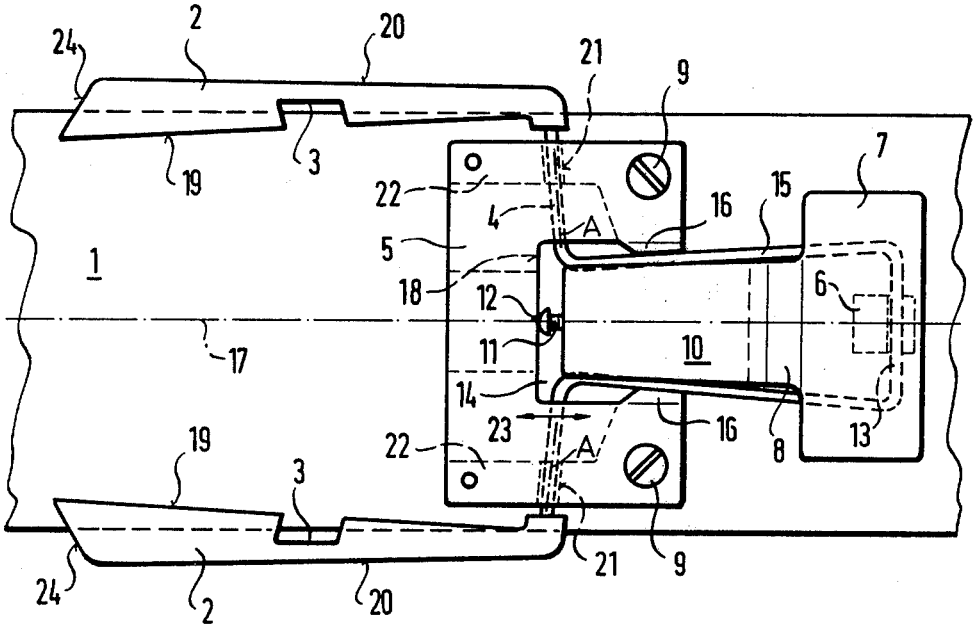
FIG. 1 is a top view of a ski brake according to this invention, shown in ineffective position.
Figure 2:
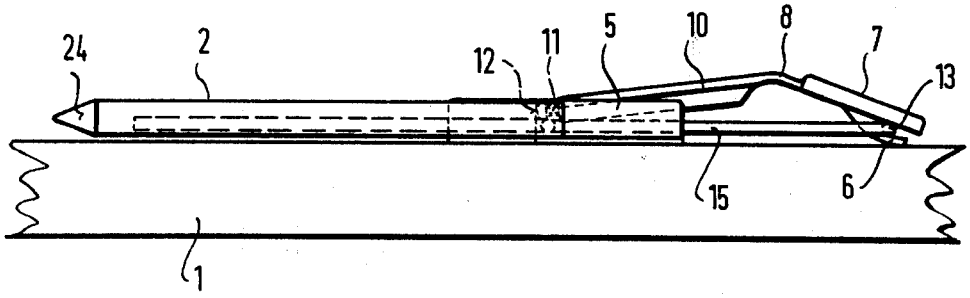
FIG. 2 is a side view of the arrangement of FIG. 1.
Figure 3:
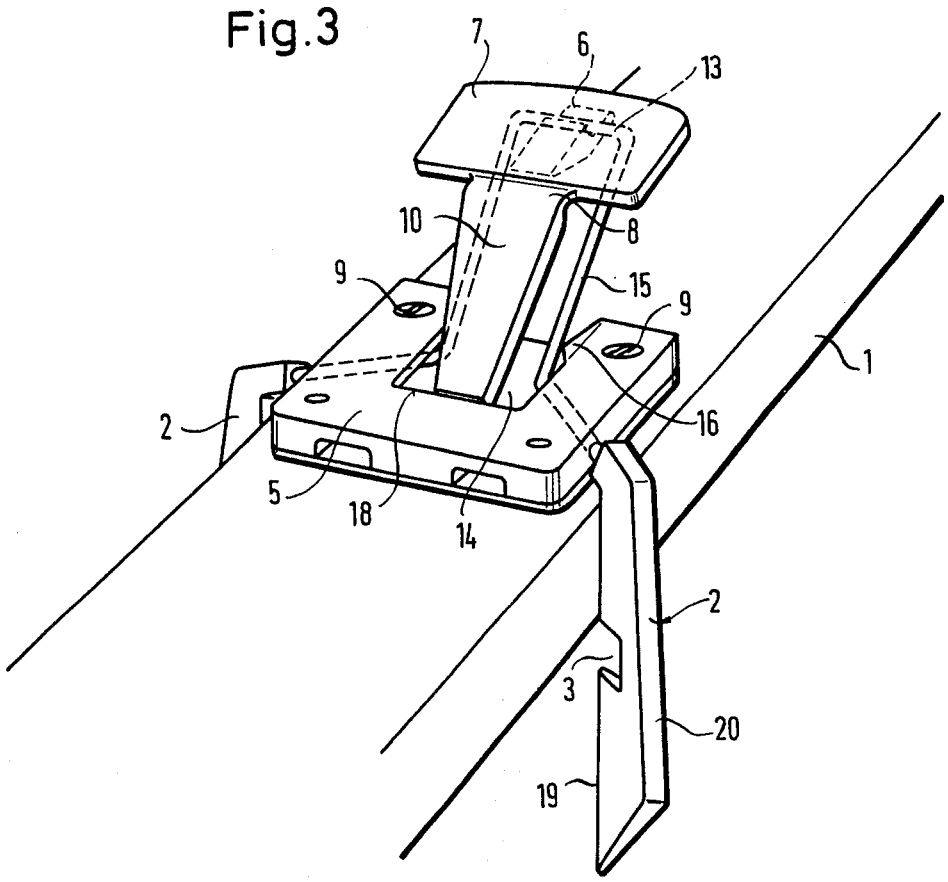
FIG. 3 is a perspective view of the arrangement shown in FIG. 1 but here shown in an actuated position.

As shown in FIGS. 1–3 a ski 1 is fitted with a support plate 5 held in place by means of screws 9 and provided with thickened side portions 22 formed with cutouts (lateral passages) 21 defining axes A extending at an angle of between 80° and 85°, here 82°, to the central longitudinal axis 17 of the ski 1. A wire of resiliently deformable spring steel is bent into a shape symmetrical about the longitudinal axis 17 and is generally U-shaped, opening toward the front of the ski. This wire has a bight portion 13 connecting a pair of legs 15 which extend forwardly on the ski and from whose forward ends diverge pivot portions 4 passing through holes 21 in the sections 22 and lying on the axis A. The wire is bent forwardly at the outer end of these pivot portions and carries brake elements 2.

The support plate or block 5 is formed with a backwardly open cutout 14 having a pair of side portions 16 engageable with the legs 15 of the wire. A one-piece synthetic-resin toggle is provided having a front section 10, a rear pedal-like section 7, and an articulation 8 interconnecting these two. The front section 10 bears via screw 11 having a head 12 on the front surface 18 of the cutout 14. The rear section 7 has a clip 6 in which is received the bight portion 13. As shown in FIG. 2 when the actuation portions 15 of the wire are depressed so as to be parallel to the upper face of the ski the two sections 7 and 10 of the toggle lie at an angle to one another. Further depression of this toggle serves to make it lie flat on top of the ski and forces the bight portion back so as to pull the pivot portions 4 at an angle and swivel the brake elements 2 inwardly on the ski. The passages 21 defining the axis A are sufficiently wide to allow such displacement of the portions 4.

The brake elements 2 have outer surfaces 20 which lie inwardly parallel to the edge of the ski and inner edges 19 which lie at an angle to the outer edges 20 and are formed with notches 3. End edges 24 on these brake elements 2 define acute angles with the inner edges 19. The notches 3 allow two skis equipped with brakes according to the present invention to be clamped together. Thus when one ski is laid bottom-to-bottom with another ski equipped with such a brake each ski will be received between the notches 3 of the brake elements 2 of the other ski. To this end the notches 3 lie just below the lower face of the ski 1 as illustrated in FIG. 3.

Adjustment of the screw 11 by screwing it in or out of the section 10 allows the rest position of the brake elements 2 to be altered.

Figure 4:
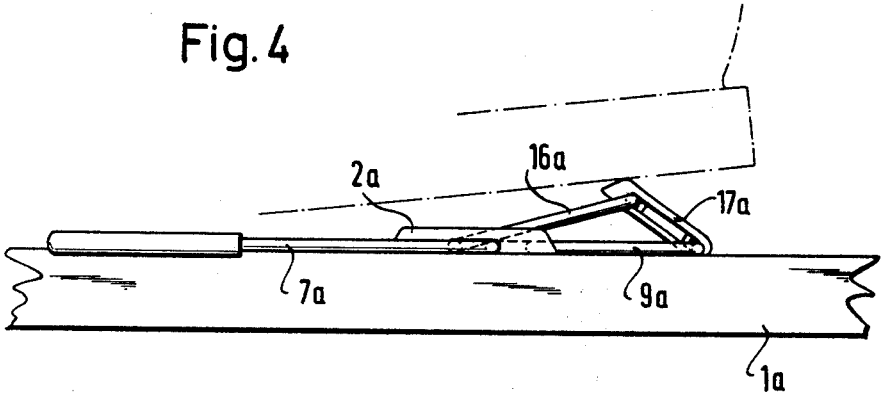
FIG. 4 is a side view of another ski brake according to this invention.
Figure 5:
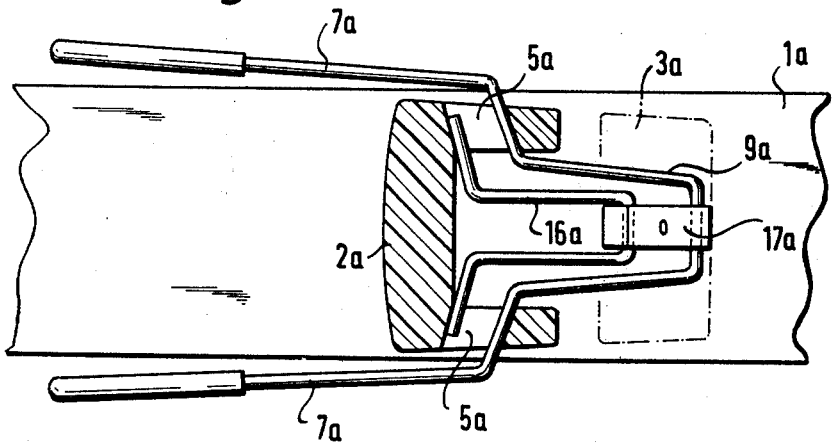
FIG. 5 is a top view, partly in section, of the arrangement shown in FIG. 4.
Figure 6:
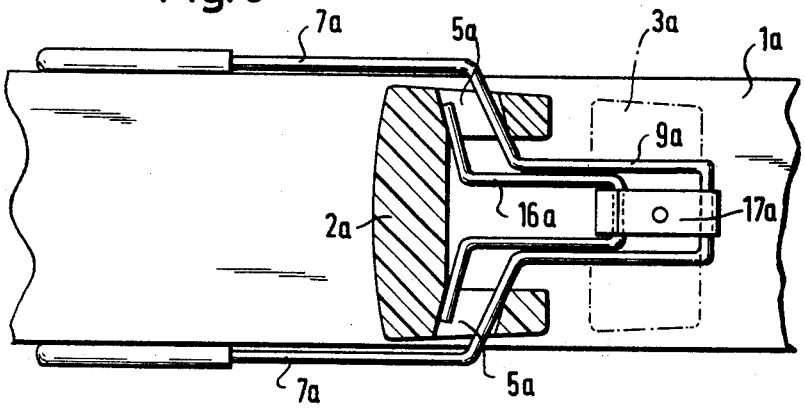
FIG. 6 is a view similar to FIG. 5 illustrating the brake in ineffective position.

The arrangement shown in FIGS. 4–6 has a ski 1*a* to whose upper face is secured a monolithic synthetic-resin mounting block 2*a*, formed with a pair of laterally opening slots 5*a* and of backwardly open U shape. A wire formed similarly to the wire of FIGS. 1–3 but here with its legs 9*a* diverging forwardly on the ski and its end portions 7*a* acting themselves as brake elements, is pivoted in this mounting block 2*a*. A rigid wire 16*a* is similarly pivoted in the block 2*a* in front of the first-mentioned wire and the bight portions of these two wires are interconnected by a rigid link 17*a* carrying a foot plate 3*a*. Thus when the link 17*a* is depressed from the position shown in FIG. 4 into a position flat against the top of the ski 1*a* it will force the bight portions between the legs 9*a* back and therefore draw the brake elements 7*a* together as can be seen by comparison of FIGS. 5 and 6.

Figure 7:
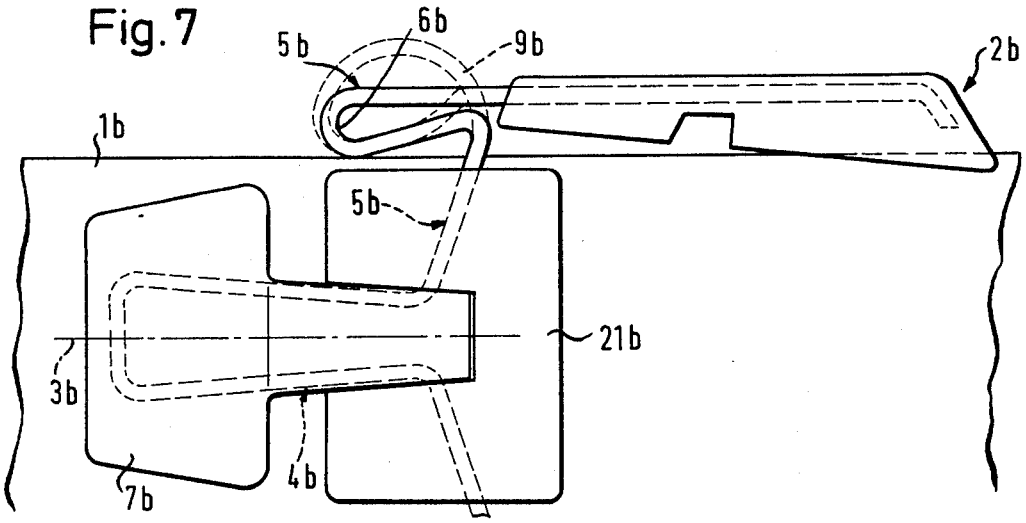
FIG. 7 is a top view of yet another ski brake according to this invention.

The arrangement shown in FIG. 7 has the ski 1*b* fitted with a mounting plate 21*b* and having an actuating pedal 7*b* in whose shank 4*b* is fitted a wire 5*b* symmetrical about a central axis 3*b* of the ski 1*b*. This wire 5*b* is formed with a loop 6*b* between its pivot portion and the portion carrying a brake element 2*b*. This loop allows the element 2*b* to bend considerably relative to the rest of the brake structure without damaging it. As illustrated at dot-dash line 9*b* a double loop may also be provided in these arrangements.

Figure 8:
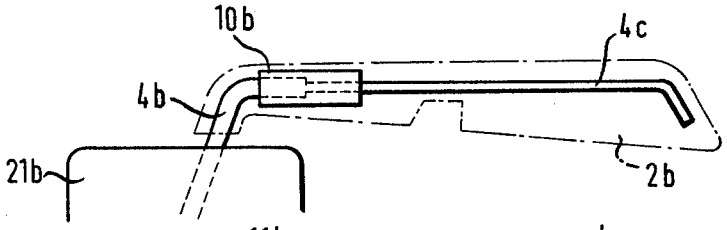
FIGS. 8–11 are top detail views of brake elements according to this invention.
Figure 9:
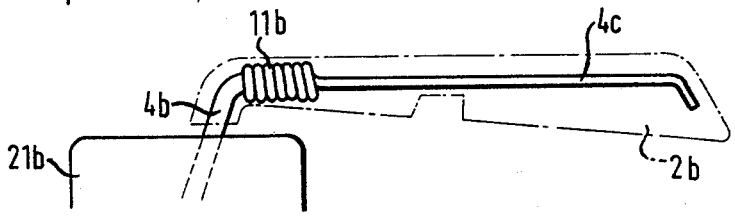
Figure 10:
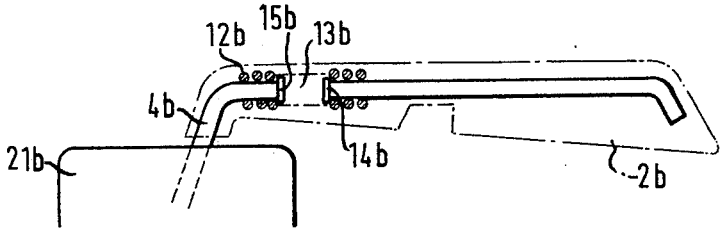

FIGS. 8, 9, and 10 show alternate forms of brake elements according to the present invention, all basically mounted on a support plate 21*b* and extending from a pivot portion 4*b*.

In the example of FIG. 8 a flexible synthetic-resin sleeve 10*b* interconnects a relatively thin end portion 4*c* with the relatively thick pivot portion 4*b*. The brake element 2*b* is formed thereon.

In FIG. 9 the relatively thin end portion 4*c* received in the element 2*b* is secured in one end of a coil spring 11*b* interconnecting these two.

FIG. 10 shows another arrangement with a relatively heavy end portion formed at its back end with a head 14*b* fitted in a spring 13*b* whose back end 12*b* is fitted beyond a head 15*b* formed on the front end of the portion 4*b*.

These arrangements of FIGS. 8–10 allow the brake element to be deflected considerably without damaging the brake arrangement.

Figure 11:
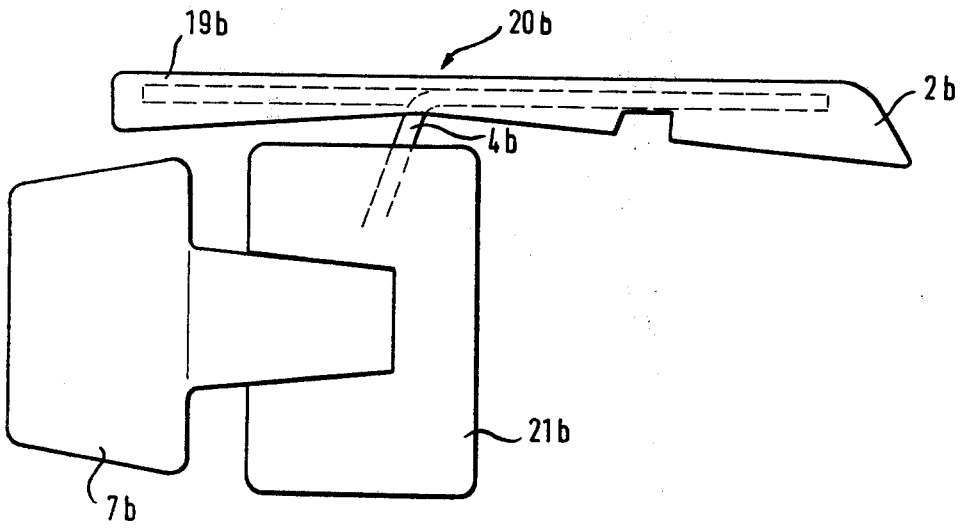

In FIG. 11 a structure identical to that of FIG. 7 is shown, except that here the wire 4*b* is bent back on itself so as to extend backwardly into a section 19*b* constituting an extension of a brake 20*b* having a front section 2*b*. This rear extension 19*b* is engageable by the heel of the ski boot of the skier.

Figure 12:
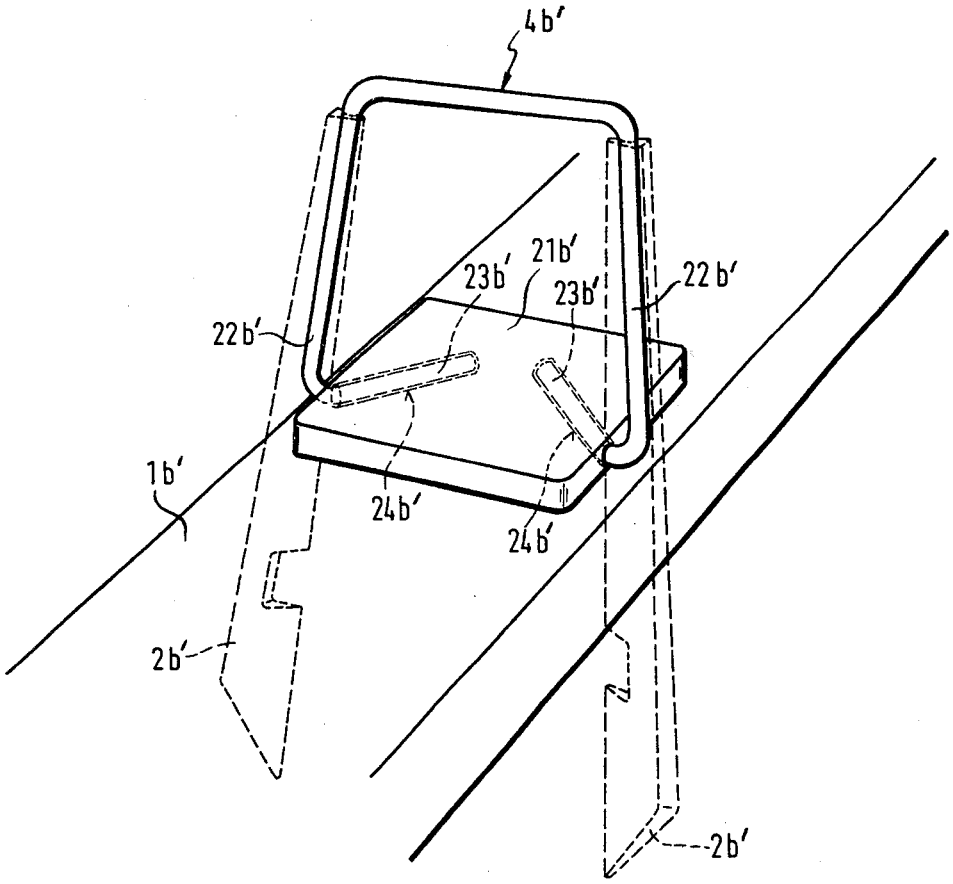
FIG. 12 is a perspective view of yet another ski brake according to the present invention.

The arrangement shown in FIG. 12 has a ski 1*b'* on which is secured a mounting plate 21*b'* having a pair of outwardly open inclined blind holes 24*b'* each receiving an end portion 23*b'* extending from an actuation portion 22*b'* of a wire having a bight portion 4*b'* interconnecting the actuation portions 22*b'*. A pair of brake elements 2*b'* extend in line with the actuation portion 22*b'*. FIG. 12 shows the system in its relaxed position, that is with the brake elements 2*b'* extending down below the lower face of the ski. When the actuation portions and bight portions 4*b* are pressed down flat against the ski these brake elements 2*b'* are pivoted up and lie parallel to the ski.

I claim:

1. In a device for braking of a ski upon the release of a skiboot from a binding thereof, comprising a support member mounted on said ski, a brake element pivotably mounted for swinging movements between a retracted inoperative position permitting free skiing and an operative brake position wherein said element is engageable with a snow surface to hold the ski released from the skiboot, and spring means acting upon said brake element for swinging same between said inoperative position and said operative position upon release of the skiboot from the ski, the improvement wherein:

said spring means is formed as a generally U-shaped bent spring wire having a pair of shanks and a bight;

at least one of said shanks is bent at an angle to form an offset portion, said support member being formed with a cam means for engaging said shanks to stress said wire upon the retention thereof by a skiboot and cause said wire to spring into said operative position upon release by said skiboot, said offset portion being swingable in said support member and forming a pivot for said brake element;

said bight is formed with an actuating member movable relative to said support member and forming a pressing surface engageable by a skiboot to retain said wire in said inoperative position while said surface is engaged by the skiboot; and a pair of such brake elements are disposed along opposite edges of the ski, each of said brake elements being secured to a respective shank of said wire.

2. The improvement defined in claim 1 wherein said offset portion forms a variable acute angle with the axis of the ski, said support means retaining said offset portion with freedom of movement thereof over the range of said variable acute angle.

3. The improvement defined in claim 18 wherein said bent wire lies substantially in a single plane transverse to the axis of said ski.

4. The improvement defined in claim 1 wherein said support member is a support plate mounted on the upper surface of said ski and formed with a cutout in the region of said bight.

5. The improvement defined in claim 4 wherein said actuating member is displaceable on said plate within said cutout.

6. The improvement defined in claim 1 wherein said support member is a support plate formed with at least one passage receiving said offset portions of said bent wire.

7. The improvement defined in claim 1, further comprising an elastic element connecting at least one of said brake elements to the respective shank of the bent wire.

8. The improvement defined in claim 7 wherein said one of said brake elements is formed with a length of wire spaced from but aligned with the respective shank, said elastic element bridging the bent wire of the latter shank and said length of wire of said one of said brake elements.

9. The improvement defined in claim 1 wherein said offset portion is formed as at least one wire loop.

10. The improvement defined in claim 1, further comprising a reduced-cross section portion of wire interposed between at least one of said brake elements and the respective shank of said bent wire.

11. The improvement defined in claim 1 wherein said actuating member is a toggle disposed along the longitudinal axis of the ski.

* * * * *

Disclaimer 3,989,271.—*Tilo Riedel,* Eching, Germany. AUTOMATIC BRAKE FOR SKI. Patent dated Nov. 2, 1976. Disclaimer filed Mar. 2, 1981, by the assignee, *S. A. Etablissements Francois Salomon & Fils.*

The term of this patent subsequent to June 22, 1993, has been disclaimed. [*Official Gazette April 7, 1981.*]